United States Patent [19]

Kaczynski et al.

[11] Patent Number: 4,788,953

[45] Date of Patent: Dec. 6, 1988

[54] DEVICE FOR INJECTING FUEL INTO A COMBUSTION CHAMBER OF AN INTERNAL COMBUSTION ENGINE

[75] Inventors: Bernhard Kaczynski, Waiblingen; Iwan Komaroff, Regensburg, both of Fed. Rep. of Germany

[73] Assignee: Robert Bosch GmbH, Stuttgart, Fed. Rep. of Germany

[21] Appl. No.: 159,522

[22] PCT Filed: Jan. 14, 1987

[86] PCT No.: PCT/DE87/00011

§ 371 Date: Jan. 7, 1988

§ 102(e) Date: Jan. 7, 1988

[87] PCT Pub. No.: WO87/06977

PCT Pub. Date: Nov. 19, 1987

[30] Foreign Application Priority Data

May 9, 1986 [DE] Fed. Rep. of Germany ..... 3615634

[51] Int. Cl.[4] ..... F02M 53/06

[52] U.S. Cl. ..... 123/297; 123/549; 123/145 A; 239/133

[58] Field of Search ..... 123/297, 298, 549, 145 A; 239/133

[56] References Cited

U.S. PATENT DOCUMENTS 1,456,018 5/1923 Wiegand ..... 123/549
2,066,860 1/1937 Shumake ..... 239/133
4,604,975 8/1986 Frey et al. ..... 123/549
4,627,405 12/1986 Imhof et al. ..... 123/298

FOREIGN PATENT DOCUMENTS 0158739 10/1985 European Pat. Off. .
1382697 11/1964 France .
2131539 6/1984 United Kingdom .

OTHER PUBLICATIONS

Patent Abstracts of Japan, vol. 7, No. 169 (M-231)(1314), Jul. 26, 1983 & JP, A, 58-74868, May 6, 1983.

*Primary Examiner*—Andrew M. Dolinar
*Attorney, Agent, or Firm*—Michael J. Striker

[57] ABSTRACT

A device for injecting fuel into a combustion chamber of an internal combustion engine, includes a glow element connected to the outlet side of an injection nozzle and having the form of a coil that widens conically toward the combustion chamber. The coil is manufactured from a flat strip, which is cut out in the form of a spiral from a flat sheet-metal element by laser cutting or for instance by an etching process and subsequently is pulled apart axially to form the coil. This facilitates the electrical contacting of the glow element and has the further advantage that the glow element can also be manufactured from special materials of the kind that are obtainable only in the form of flat plates or strips.

4 Claims, 1 Drawing Sheet

DEVICE FOR INJECTING FUEL INTO A COMBUSTION CHAMBER OF AN INTERNAL COMBUSTION ENGINE

BACKGROUND OF THE INVENTION

The invention relates to a device for injecting fuel into a combustion chamber of an internal combustion engine. In devices of this type, the cross section of the annular chamber surrounding the flow element increases toward the injection nozzle, resulting in an overall improvement in the flow conditions for the aspirated air.

If the glow element furthermore has a wall thickness that remains constant over the entire length, then its inner passageway also adapts better to the shape of the injection stream, as a result of which injector effect of the injection streams passing through the glow element is also intrinsically increased. In the version described in applicant German patent Application the electrical contacting of which requires increased time and effort, because of the lack of flat contact faces on the round wire.

SUMMARY OF THE INVENTION

It is an object of this invention to provide an improved arrangement for the fuel injection for internal combustion engines.

The arrangement according to the invention has the advantage over the prior art that with relatively little time and effort, reliable electrical contacting and retention of the glow element are possible. As material for the glow element, it is also possible to use special materials of the kind that are obtainable only as flat material, in the form of plates and strips. With equally large interstices between turns and therefore an equally good admixture of aspirated air in the peripheral zones of the injection streams passing through the glow element, the moment of resistance to flow factors is increased in comparison with heating coils made from round wire. The glow element can be manufactured in a cost-effective manner using sheet-metal plates or strips available in commerce.

The shape of the flat strip forming the glow element can be obtained extremely accurately if the flat strip is a shaped element cut by laser or by etching.

A particularly reliable contacting of the glow element can be attained if one closed contact ring each is formed onto the ends of the flat strip forming the glow element. In that case, the contact rings can at the same time advantageously act as a means of centering and fastening the glow element on a holder; the holder can for instance be embodied as a sleeve supported on the nozzle adjusting nut and surrounding the glow element with radial play.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENT

Figure 1:
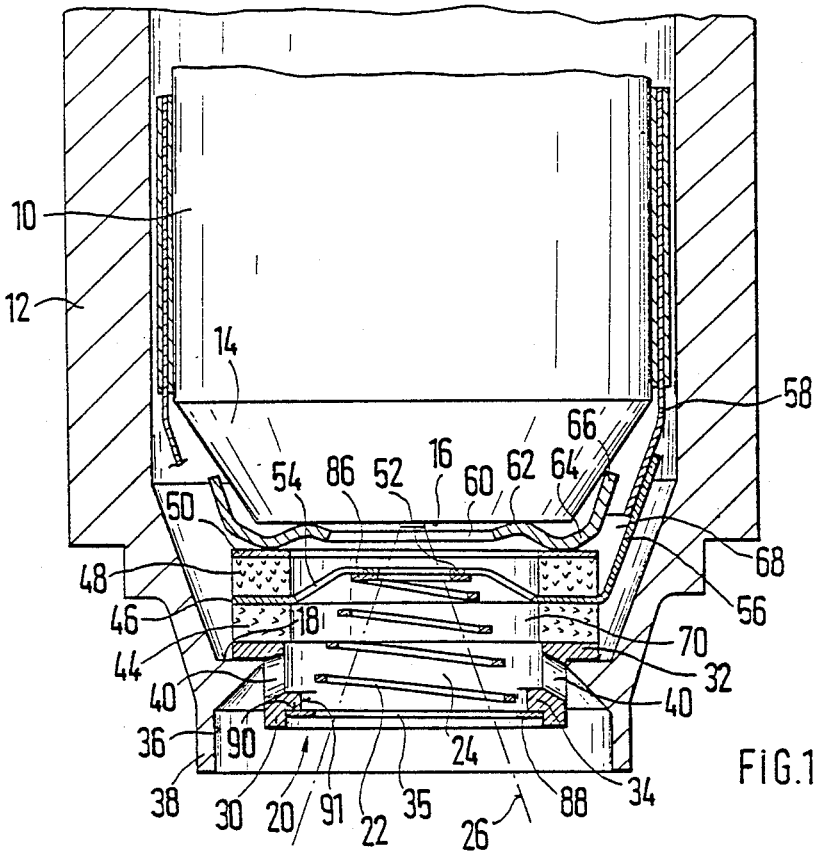
FIG. 1 shows an enlarged longitudinal section taken through the end toward the combustion chamber of an injection nozzle and a glow insert integrated with the clamping nut of the nozzle.

The device includes an injection nozzle having a nozzle body 10, in which in a known manner a valve seat is formed and a valve needle is displaceably supported. The nozzle body 10 and an intermediate washer that limits the stroke of the valve needle are fastened by means of a clamping nut 12 to a nozzle holder, in which among other elements, a closing spring that presses the valve needle against the valve seat is accommodated. On the end face at the side of the combustion chamber, the nozzle body 10 is provided with a conical wall portion 14, which merges into a flat end wall 16.

The clamping nut 12 is extended beyond the nozzle holder 10 toward the combustion chamber, and downstream from its end wall 16 is provided with an inner support shoulder 18, on which a glow insert identified overall by reference numeral 20 rests. This glow insert has as a central structural component a glow element 22 embodied as a helix, which forms a passageway 24 for the injection streams 26. The glow element 22 is dimensioned such that the injection streams do not moisten the glow element, but instead produce an injector action, by means of which air is aspirated out of the combustion chamber into the interior of the glow element 22 and into the peripheral zones of the injection streams passing through the glow element.

The glow element 22 is surrounded by a metal sleeve 30, which has a flange 32 that rests on the support shoulder 18 of the clamping nut 12. On the side which faces the combustion chamber, the sleeve 30 is provided with an inwardly oriented annular collar 34, on which the end turn 35 at the side of the combustion chamber of the glow element 22 is supported in a centered manner and, for instance, soldered in place. Downstream of the support shoulder 18, the clamping nut 12 has an enlarged bore portion 36 formed in an annular collar 38, which protectively surrounds the end of the sleeve 30 at the side of the combustion chamber; after "and" insert the end; and the end of the glow element 22. Between the flange 32 and the annular collar 34, the peripheral wall of the sleeve 30 is provided with a plurality of uniformly distributed bores 40, which discharge into the enlarged bore portion 36 of the clamping nut 12.

A first annular insulating body 44, a metal contact ring washer 46, a second annular insulating body 48 and a metal support washer 50 rest on the sleeve 30, one above the other. These elements are firmly connected with one another and with the sleeve 30, for instance by soldering, and when they are joined together they are centered with respect to one another without further aids, solely by means of the suitable embodiment of a joining tool. The upstream end of the glow element 22 is soldered to an inner annular zone 52 of the contact ring washer 46, which is provided with a plurality of uniformly distributed openings 54 in the middle area of the ring. On the outer rim of the ring, the contact ring washer 46 is provided with three upwardly protruding contact lugs 56, which are offset by 120° from one another and are conductively joined to a current carrying sleeve 58 that extends through them, insulated by the annular gap between the nozzle body 10 and the clamping nut 12, as far as a connection site, located at a higher level, of an external supply line.

Between the support washer 50 and the nozzle body 10, a metal thermal insulation ring 60 is fastened in a deformed manner, pressing with an inner ring rim 62 against the end wall 16 of the nozzle body 10. A middle annular region 64 of the thermal insulation ring 60 that is axially offset with respect to the inner ring rim 62 rests on the support ring 50, and an outer ring rim 66 rests on the conical wall portion 14 of the nozzle body 10. As a result, the thermal insulation ring 60 is centered on the nozzle body 10, and the passageway 24 is satisfactorily sealed off from the chamber 68 surrounding the thermal insulation ring 60.

Between the sleeve 30 and the glow element 22, an annular chamber 70 is formed, which communicates via the bores 40 in the sleeve 30 and via the enlarged bore portion 36 of the clamping nut with the combustion chamber. Via the flow path described and the interstices between turns of the glow element 22, the injection streams 26 aspirate air from the combustion chamber by injector action, and this air, heated at the glow element (22), reaches the peripheral zones of the injection streams and there forms a readily ignitable fuel-air mixture. Because of the structure of the glow element 22, which is well adapted to the shape of the stream, the injector action of the injection streams 26 is improved. The enlargement of the cross section of the annular chamber 70 toward the injection nozzle makes for a uniform entry of air into the injection streams over the entire length of the glow element 22, and thermally relieves the insulating elements 44, 48 and the points where they are connected to the metal parts contacting them. The conical shape also improves the dynamic behavior of the glow coil and reduces the danger of breakage.

The pre-fabricated assembly embodied by the elements 22, 30 and 44–50, is inserted into the clamping nut 12 from the upstream side theroef and pushed in until it rests on the support shoulder 18. After that, the sleeve assembly can be glued, soldered or welded to the clamping nut 12 at a suitable point. The subsequent assembly of the injection nozzle is suitably effected such that the nozzle holder, the intermediate washer and the nozzle body 10 are placed on one another in reverse order; the thermal insulation ring 60 is slipped onto the nozzle body 10, and then the union nut 12 and the glow insert 20 together are folded over onto the parts and screwed onto the nozzle holder, during which the self-clamping thermal insulation ring 60 is kept centered on the nozzle holder 10.

Figure 2:
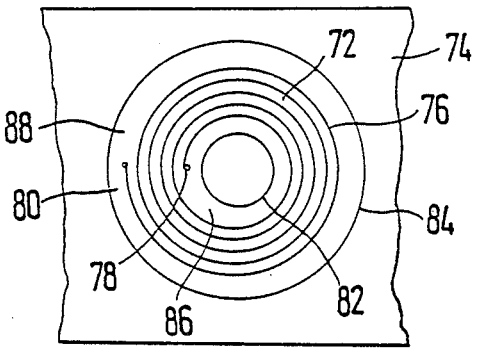
FIG. 2 shows a plan view on the glow element of the glow insert of FIG. 1 in an intermediate stage in manufacture.

The glow element 22 is wound from a flat strip 72 (FIG. 2) so that the individual turns have a rectangular cross section. The flat strip 72 is cut out of a flat sheet-metal element in the form of a spiral and after that is pulled apart in the axial direction of the glow element 22 to form the conical helix. The spiral can for instance be cut out of the flat sheet-metal element by etching or, as shown in FIG. 2, by laser cutting. In FIG. 2 the flat starting portion is a sheet-metal strip 74, from which the spiral flat strip 72 is cut out by means of a cutting line 76 that begins at 78 and terminates at 80. In addition to the cutting line 76, an inner circular cutting line 82 and an outer circular cutting line 84 are provided, with which the spiral is cut out of the metal strip 74.

Because of the two cutting lines 82 and 84, the glow element 22 gains an inner closed contact ring 86 and an outer closed contact ring 88 at its ends, with which the glow element 22 is electrically contacted at the contact ring washer 46 and sleeve 30. By means of the described embodiment of the glow element 22, flat bearing surfaces are produced between the parts that are to be electrically contacted, and these bearing surfaces furthermore extend over one entire circular circumference and therefore enable excellent electrical contact and fastening.

It will be understood that each of the elements described above, or two or more together, may also find a useful application in other types of devices for injecting fuel into internal combustion engines differing from the types described above.

While the invention has been illustrated and described as embodied in a device for injecting fuel into internal combustion chamber of an internal combustion engine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for injecting fuel into a combustion chamber of an internal combustion engine, comprising an injection nozzle; a glow element connected to an outlet side of an injection opening of the injection nozzle, the glow element forming passageway for injection streams; means defining an annular chamber that communicates with the combustion chamber of the internal combustion engine and surrounding said glow element and from which passages lead into the path of the injection streams, said passages causing the injection streams to aspirate air from the combustion chamber by injector action, said glow element being formed as a helix, which has an outside diameter which decreases continuously toward the injection nozzle, said glow element being formed from a flat strip (72), which is cut in the form of a spiral from a flat sheet-metal element (4) and is then pulled apart in the axial direction of the glow element so as to form a conical helix.

2. A device as defined by claim 1, wherein the flat strip (72) forming the glow element is a laser-cut shaped element.

3. A device as defined by claim 1, wherein the flat strip (72) forming the glow element is an etched shaped element.

4. A device as defined by claim 1, further including closed contact rings each integrally formed onto each of the ends of the flat strip (72) forming the glow element (22).

* * * * *